US009850687B2

(12) United States Patent
Roatis

(10) Patent No.: US 9,850,687 B2
(45) Date of Patent: Dec. 26, 2017

(54) INTEGRATED MECHANICAL LOCK AND MOTORIZED LOCK MECHANISM

(71) Applicant: TriTeq Lock and Security LLC, Elk Grove Village, IL (US)

(72) Inventor: Calin V. Roatis, Long Grove, IL (US)

(73) Assignee: TriTeq Lock and Security, LLC, Elk Grove Village, IL (US)

( * ) Notice: Subject to any disclaimer, the term of this patent is extended or adjusted under 35 U.S.C. 154(b) by 0 days.

(21) Appl. No.: 14/931,268

(22) Filed: Nov. 3, 2015

(65) Prior Publication Data

US 2016/0123039 A1 May 5, 2016

Related U.S. Application Data

(60) Provisional application No. 62/075,210, filed on Nov. 4, 2014.

(51) Int. Cl.

| | |
|---|---|
| ***E05B 47/00*** | (2006.01) |
| ***E05B 65/46*** | (2017.01) |
| ***E05B 65/462*** | (2017.01) |
| ***E05B 47/06*** | (2006.01) |

(52) U.S. Cl.

CPC ..... *E05B 65/462* (2013.01); *E05B 47/0012* (2013.01); *E05B 47/0607* (2013.01); *E05B 2047/0017* (2013.01); *E05B 2047/0024* (2013.01); *E05B 2047/0084* (2013.01); *E05B 2047/0091* (2013.01)

(58) Field of Classification Search

CPC .. E05B 47/0001; E05B 47/06; E05B 47/0607; E05B 2047/0014; E05B 2047/0015; E05B 2047/0017; E05B 2047/0024; E05B 2047/0084; E05B 2047/0086; E05B 65/46; E05B 65/462; E05B 65/467

See application file for complete search history.

(56) References Cited

U.S. PATENT DOCUMENTS

| | | | | | |
|---|---|---|---|---|---|
| 5,172,967 | A * | 12/1992 | Pipe | E05B 47/0002 | 312/217 |
| 5,805,074 | A * | 9/1998 | Warren | E05B 65/462 | 70/78 |
| 6,116,067 | A * | 9/2000 | Myers | E05B 65/462 | 70/78 |
| 6,374,649 | B1 * | 4/2002 | Holcomb | E05B 65/468 | 70/78 |
| 6,726,294 | B1 * | 4/2004 | Muller | E05B 65/462 | 312/215 |

(Continued)

*Primary Examiner* — Christopher Boswell
(74) *Attorney, Agent, or Firm* — Charles T. Riggs Jr.

(57) ABSTRACT

A locking mechanism is selectively operable both electronically and mechanically by way of an integrated mechanical lock and motorized lock mechanism. A motorized lock mechanism is incorporated with a mechanical lock to provide for keyless access, while the mechanical lock and key system remains as a back-up. A toggle assembly is selectively positioned either mechanically via a first cam, or electronically via a second cam, both selectively operable independently of each other, without interference from each other, to move the toggle assembly to its unlocked position. A spring biases the toggle assembly to its locked position when the first and second cams are in their locked positions.

23 Claims, 14 Drawing Sheets

(56) References Cited

U.S. PATENT DOCUMENTS

| | | | | |
|---|---|---|---|---|
| 7,891,222 | B2 * | 2/2011 | Ratkus | E05B 47/0012 70/78 |
| 8,616,031 | B2 * | 12/2013 | Ullrich | E05B 47/0012 70/78 |
| 8,733,854 | B1 * | 5/2014 | Chang | E05B 47/0012 312/217 |
| 9,382,730 | B1 * | 7/2016 | Chen | E05B 65/462 |
| 2005/0199022 | A1 * | 9/2005 | Friar | E05B 47/0012 70/78 |
| 2007/0050051 | A1 * | 3/2007 | Chang | E05B 47/026 700/17 |

* cited by examiner

INTEGRATED MECHANICAL LOCK AND MOTORIZED LOCK MECHANISM

TECHNICAL FIELD

The exemplary teachings herein pertain to lock mechanisms, and method(s), system(s) and device(s) for locking an enclosure, such as a filing cabinet, tool cabinet or other lockable enclosure. In particular, the present disclosure relates to a locking mechanism selectively operable both electronically and mechanically by way of an integrated mechanical lock and motorized lock mechanism.

BACKGROUND

In the prior art (see FIGS. 1-9), a cabinet 1 includes a mechanical locking and latching system whereby the mechanical lock 2 is rotated about a first axis, the first axis being longitudinal to the cabinet from to back. A conventional key is required to turn or rotate, and thus lock and unlock, the mechanical rotating lock 2.

FIG. 1 is a perspective view of the prior art cabinet 1 having the mechanical rotating lock 2. FIG. 2 is an enlarged partial top perspective view of the prior art cabinet 1 without its top surface, showing a lock drive shaft or lock bar 3 and a locking assembly 5 at the rear of the cabinet. The rotating lock 2 attaches to the lock drive shaft 3 that rotates about the first longitudinal axis. The lock drive shall 3 connects to a cam 4 that is also rotated about the first axis (see FIGS. 3-5).

FIG. 3 is a rear view of locking assembly 5 which is mounted to a mounting bracket 6. FIGS. 4 and 5 are rear views of locking assembly 5 without the mounting bracket 6. As shown in FIGS. 4 and 5, the locking assembly includes a toggle bracket 11 which is selectively driven to the left or right by the mechanical lock moving cam 4. In FIG. 4, the toggle bracket 11 has been driven left to the locked position by the cam 4. In FIG. 5, the toggle bracket 11 has been driven right to the unlocked position by the cam 4. Movement of the cam 4 is controlled by rotation of lock 2 and lock drive shaft 3 using a key (not shown).

FIG. 6 is a bottom view of locking assembly 5 showing a lock bar 7 latched with a drawer hook 8 in the locked position. FIG. 7 is a bottom view of locking assembly 5 showing the lock bar 7 free from the drawer hook 8 in the unlocked position. FIG. 8 is a detail view of FIG. 7 (unlocked). Movement of the lock bar 7 into and out of engagement with the drawer hook 8 is controlled by movement of the toggle bracket 11 as described below with respect to FIG. 9.

FIG. 9 shows the locking bar 7 as it is connected to the toggle bracket 11 by a lock bar pin or hinge pin 9. Lock bar 7 will pivot from locked to unlocked as drive shaft 3 is rotated to rotate earn 4 and slide toggle bracket 11 from left to right. Toggle bracket 11 is generally "L" shaped and comprises the first slot configured in a plane perpendicular to the first axis, and a second slot configured in a plane that is parallel to the first axis and perpendicular to the plane of the first slot. The first slot is illustrated as the generally square opening in toggle bracket 11 in which cam 4 is positioned. Movement of toggle bracket 11 is controlled by the cam 4 moving in and pushing against the sides of the first slot. The second slot is used to control a lock bar hinge via the lock bar hinge pin 9. As the toggle bracket 11 slides from left to right to unlock the cabinet, the second slot is shifted from the left to the right and applies a rotation force on the hinge pin 9, thereby rotating the lock bar hinge and thus the lock bar 7 out from a position that interferes with the drawers of the cabinet. Conversely, as the toggle bracket 11 slides from right to left to lock the cabinet, the second slot is shifted from the right to the left and applies a rotation force on the hinge pin 9, thereby rotating the lock bar hinge and thus the lock bar 7 into a position that interferes with the drawers of the cabinet.

While such a conventional mechanical lock and key system is adequate to lock and unlock a cabinet, it is often more preferable to utilize at keyless access system to lock and unlock such cabinets. Therefore, a need exists for one or more methods, systems and devices which are directed towards providing keyless access for a cabinet having a conventional mechanical lock and key system. Accordingly, to address the above stated issue(s), the method(s), system(s) and device(s) disclosed herein, which integrates a motorized lock mechanism with the mechanical lock, fulfill such a need.

SUMMARY

The exemplary technique(s), system(s), device(s) and method(s) presented herein relate to an integrated mechanical lock and motorized lock mechanism for an enclosure, such as a filing cabinet, tool cabinet or other lockable enclosure, and in particular an enclosure with drawers. As disclosed herein, a motorized lock mechanism is incorporated with the mechanical lock to provide for keyless access. A keypad or a transmitter fob controls the motorized lock mechanism to provide for keyless access, such that no key is required to lock and unlock the cabinet. The mechanical lock and key system remains as a back-up in case the electronics fail or the keypad code or transmitter fob is lost. As such, the mechanical lock and key can be used at any time to take over operation from the keyless motorized lock mechanism.

In the preferred embodiment of the present disclosure, the mechanical lock 2, drive shaft 3, cam 4 and lock bar 7 are maintained; however, the toggle assembly is modified. The toggle bracket first slot in a plane perpendicular to the first axis is maintained. An additional surface in the toggle bracket is added to interface with a second cam that is driven by a motor. As the motor rotates the second cam, the toggle bracket is driven to the right or to the unlocked position. Further, a spring is connected to the toggle bracket to bias the toggle bracket to the locked position. As the second cam is rotated to a position that no longer drives the toggle bracket to the unlocked position, the spring moves the toggle bracket to the locked position. A key can be used to rotate the mechanical lock 2 and ram 4 to move the modified toggle bracket to the right, against the bias of the spring, to the unlocked position.

Additional objects, advantages and novel features will be set forth in part in the description which follows, and in part will become apparent to those skilled in the art upon examination of the following and the accompanying drawings or may be learned by production or operation of the examples.

BRIEF DESCRIPTION OF THE DRAWINGS

The drawing figures depict one or more implementations in accord with the present teachings, by way of example only, not by way of limitation. In the drawing figures, like reference numerals refer to the same or similar elements.

DETAILED DESCRIPTION

The following description refers to numerous specific details which are set forth by way of examples to provide a thorough understanding of the relevant teachings. It should be apparent to those skilled in the art that the present teachings may be practiced without such details. In other instances, well known methods, procedures, and components have been described at a relatively high-level, without detail, in order to avoid unnecessarily obscuring aspects of the present teachings.

FIGS. 10-14 illustrate a cabinet with the integrated mechanical lock and motorized lock mechanism of present disclosure. In this embodiment, the locking bar 7 and drawer hook 8 will continue to operate as described above.

Figure 10:
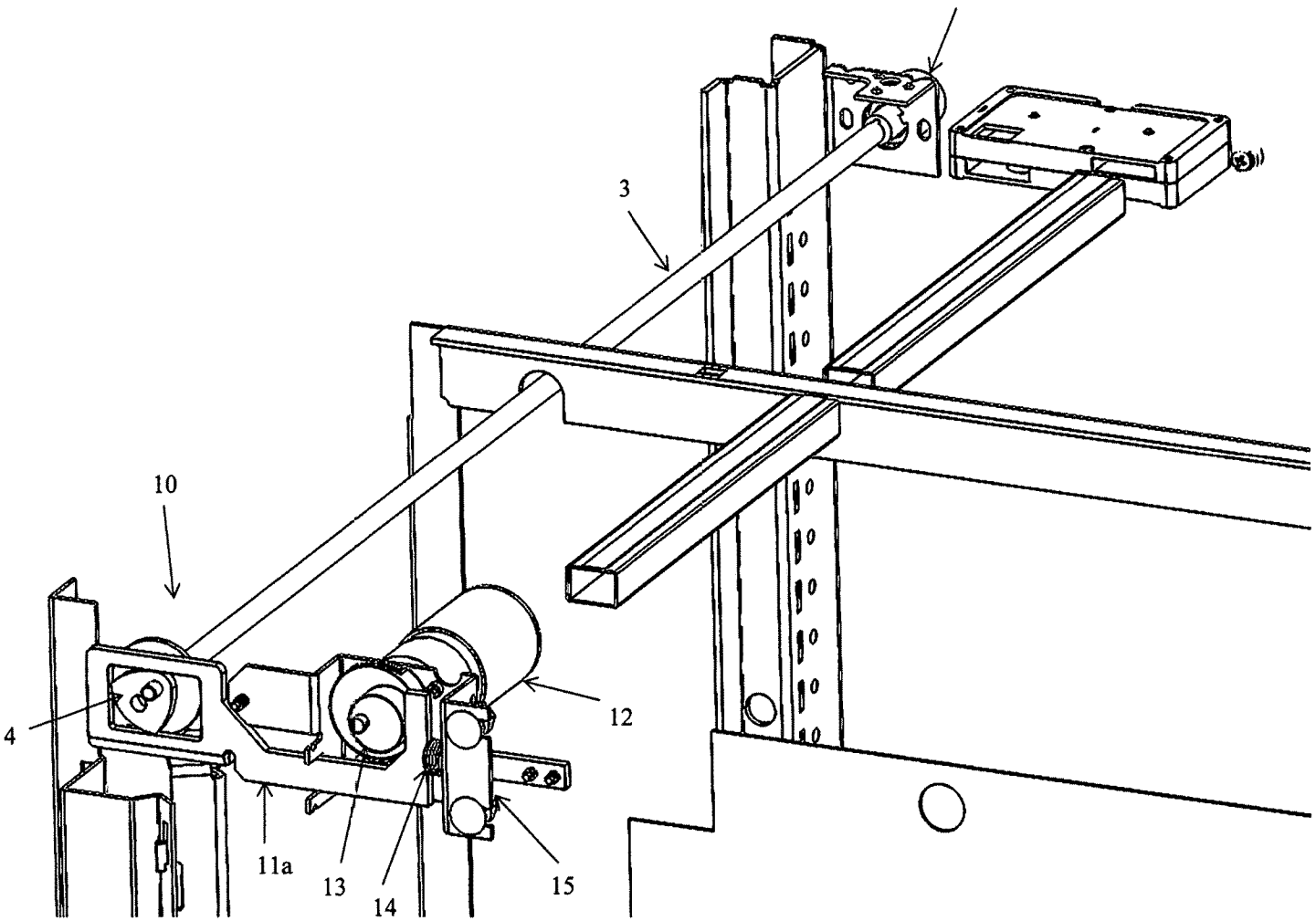
FIG. 10 is a partial top rear perspective view of a cabinet without its top surface view illustrating the integrated mechanical lock and motorized locking mechanism of the present disclosure.

FIG. 10 is a perspective view of the integrated mechanical lock and motorized lock mechanism 10 of present disclosure. The integrated mechanical lock and motorized lock mechanism 10 comprises a toggle bracket 11*a*, a motor 12, a motor cam 13, a spring 14 and a mounting bracket 15.

Figure 1:
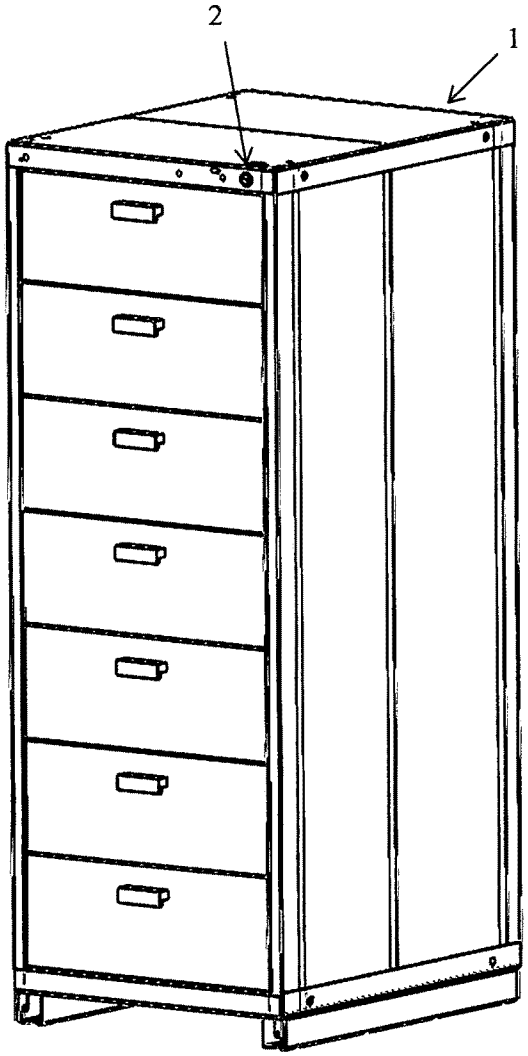
Figure 1 (Prior Art)
FIG. 1 is a perspective view of a prior art cabinet with a mechanical lock.
Figure 2:
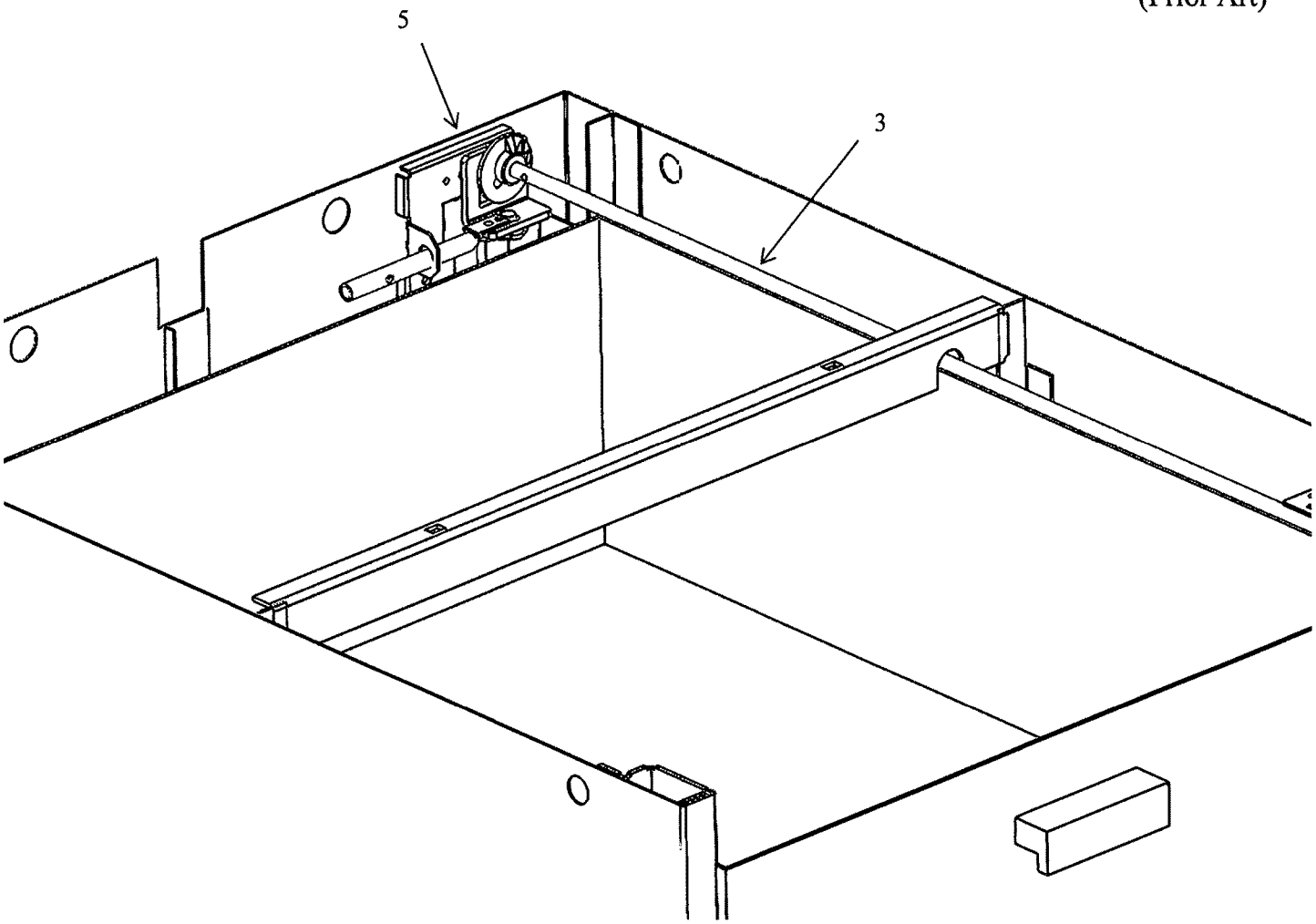
Figure 2 (Prior Art)
FIG. 2 is a partial top perspective view of the cabinet of FIG. 1 without its top surface.
Figure 3:
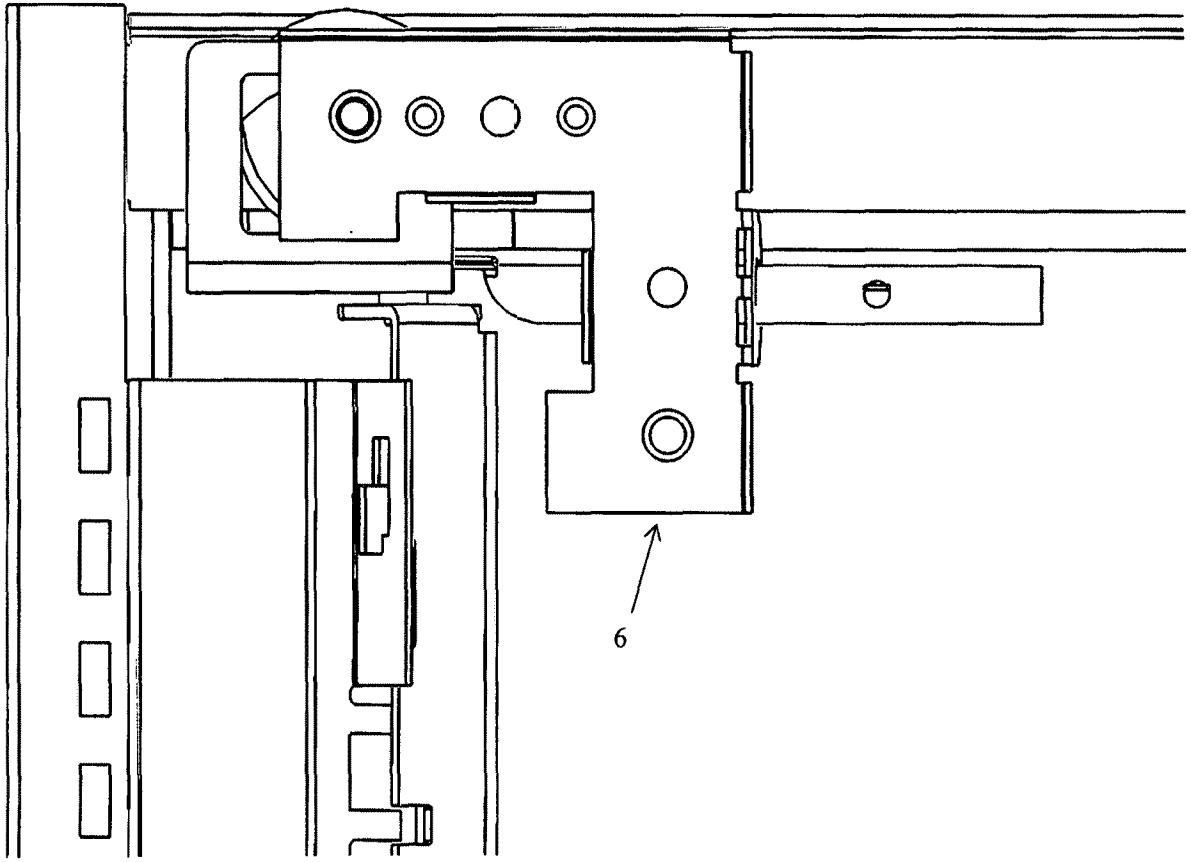
Figure 3 (Prior Art)
FIG. 3 is a rear view of a prior art locking assembly used in the cabinet of FIG. 1.
Figure 4:
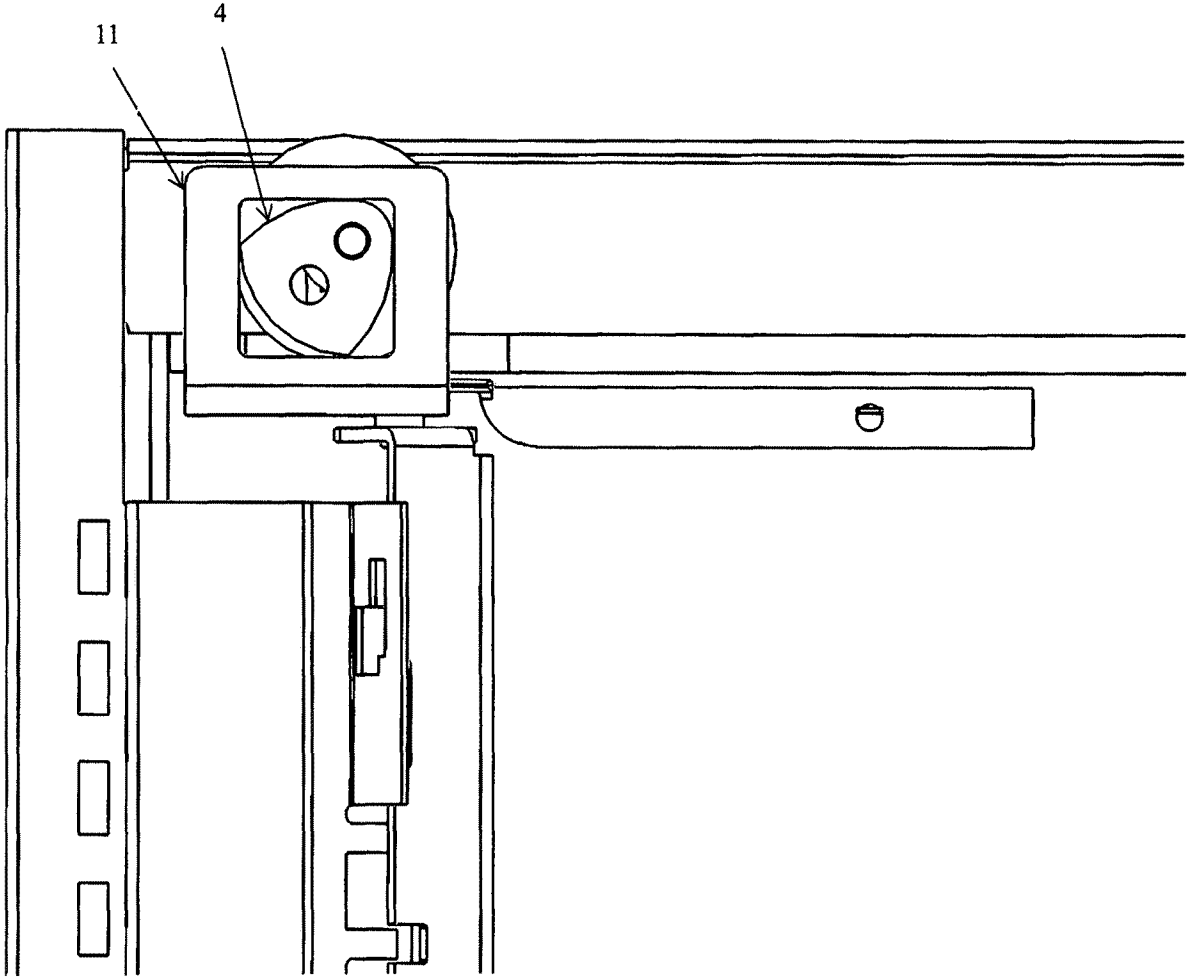
Figure 4 (Prior Art)
FIG. 4 is a rear view of the prior art locking assembly of FIG. 3 without its mounting bracket and in its locked position.
Figure 5:
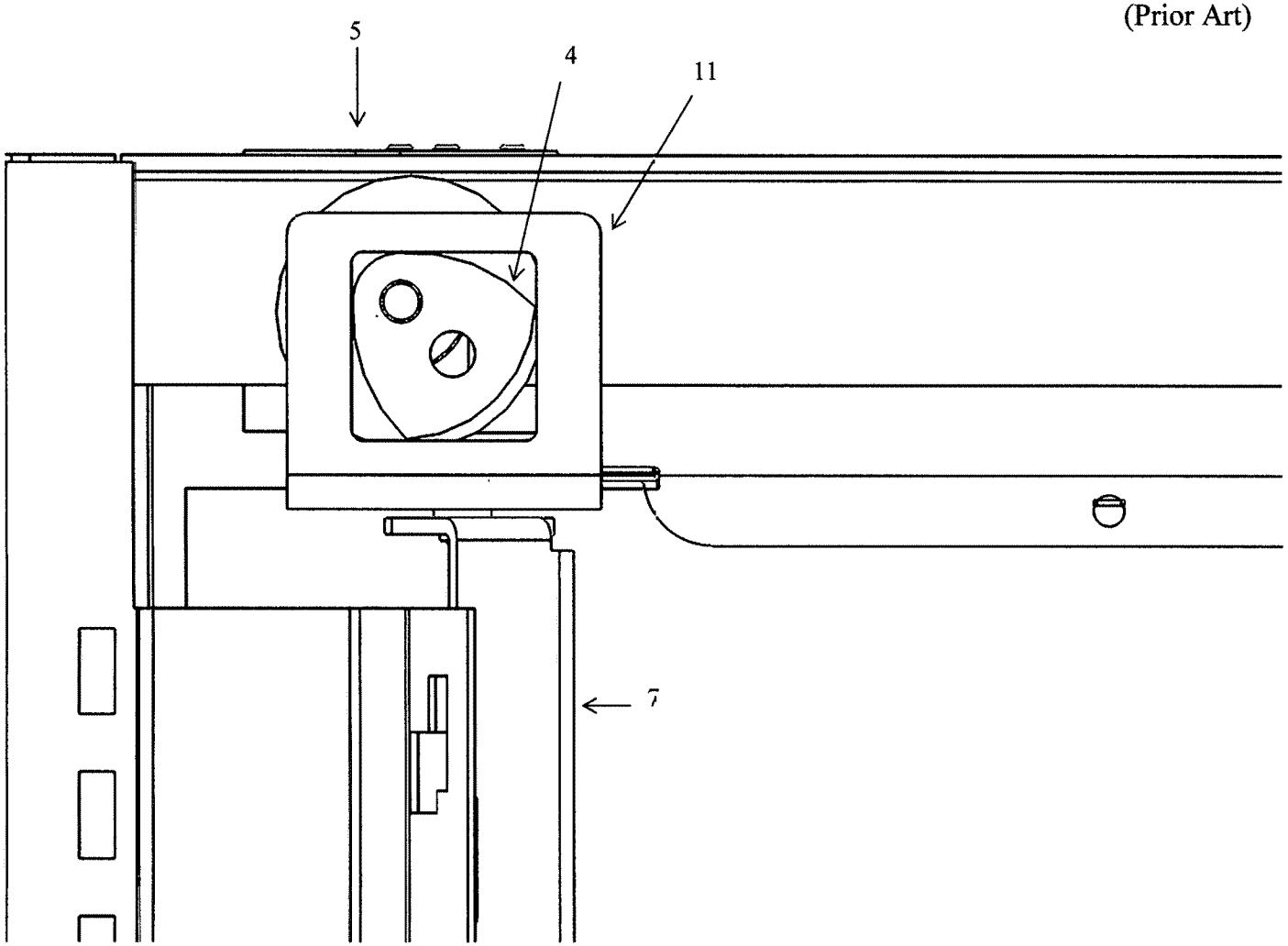
Figure 5 (Prior Art)
FIG. 5 is a rear view of the prior art locking assembly of FIG. 3 without its mounting bracket and in its unlocked position.
Figure 6:
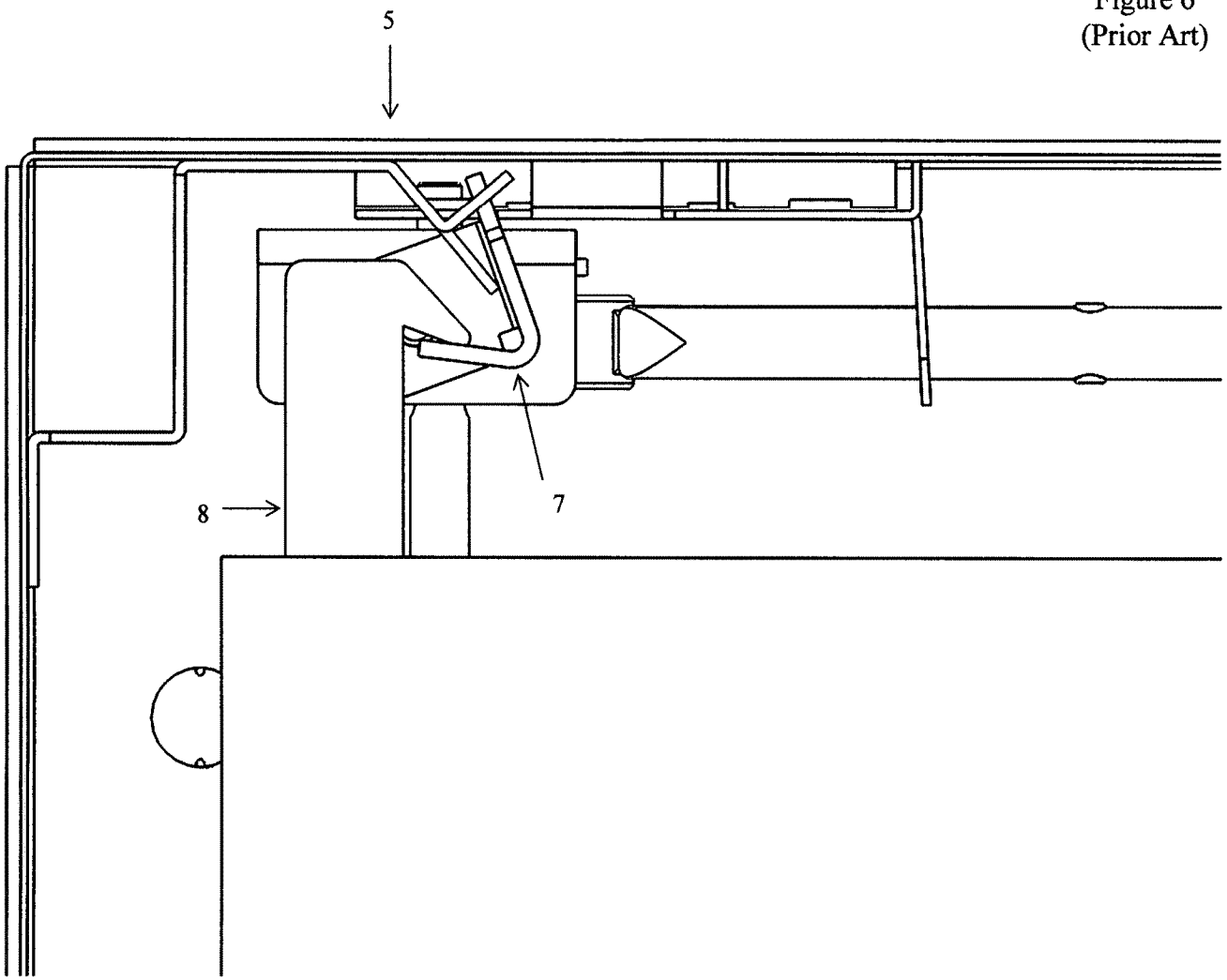
Figure 6 (Prior Art)
FIG. 6 is a bottom view of the prior art locking assembly of FIG. 3 in its locked position.
Figure 7:
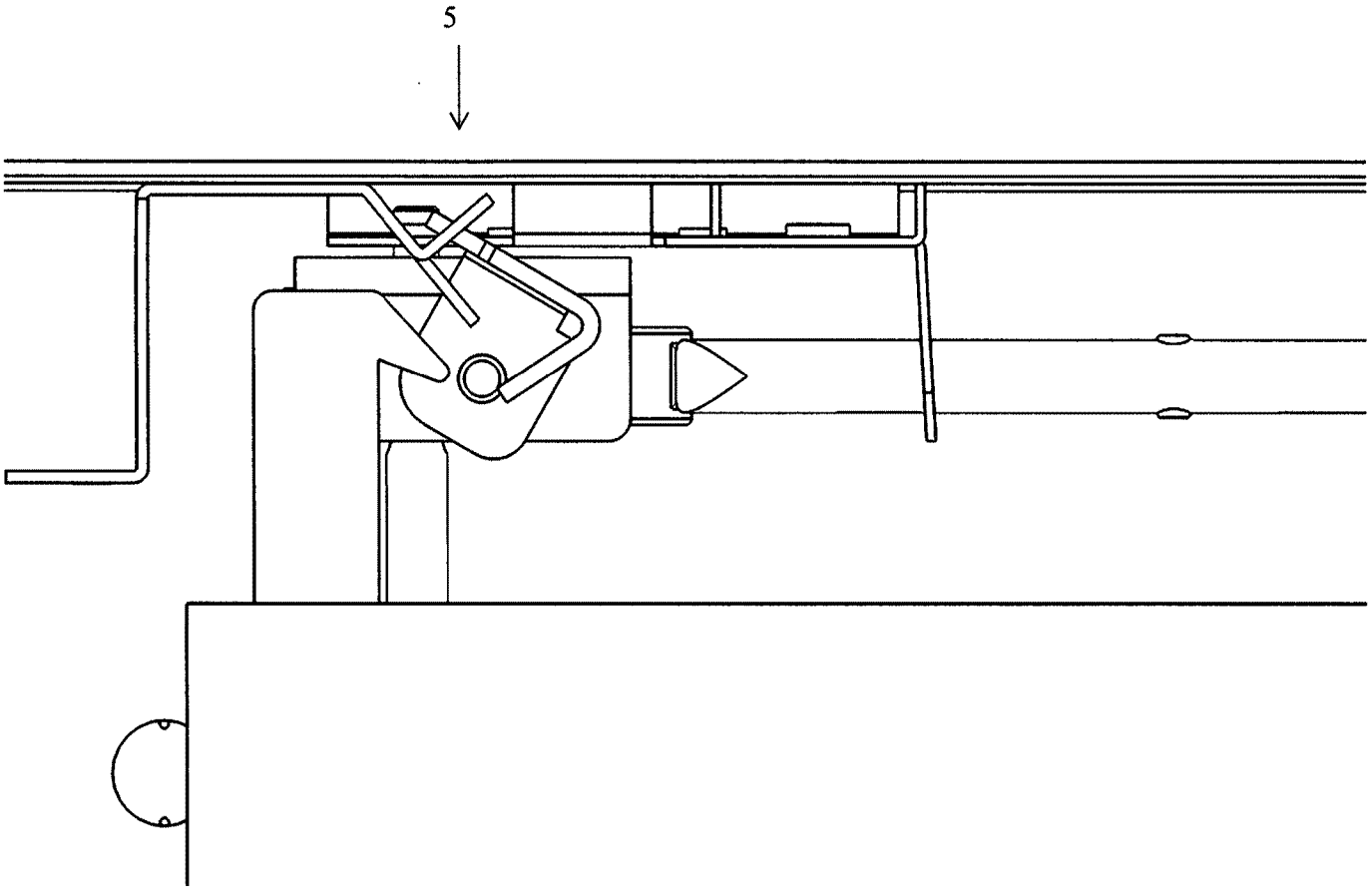
Figure 7 (Prior Art)
FIG. 7 is a bottom view of the prior art locking assembly of FIG. 3 in its unlocked position.
Figure 8:
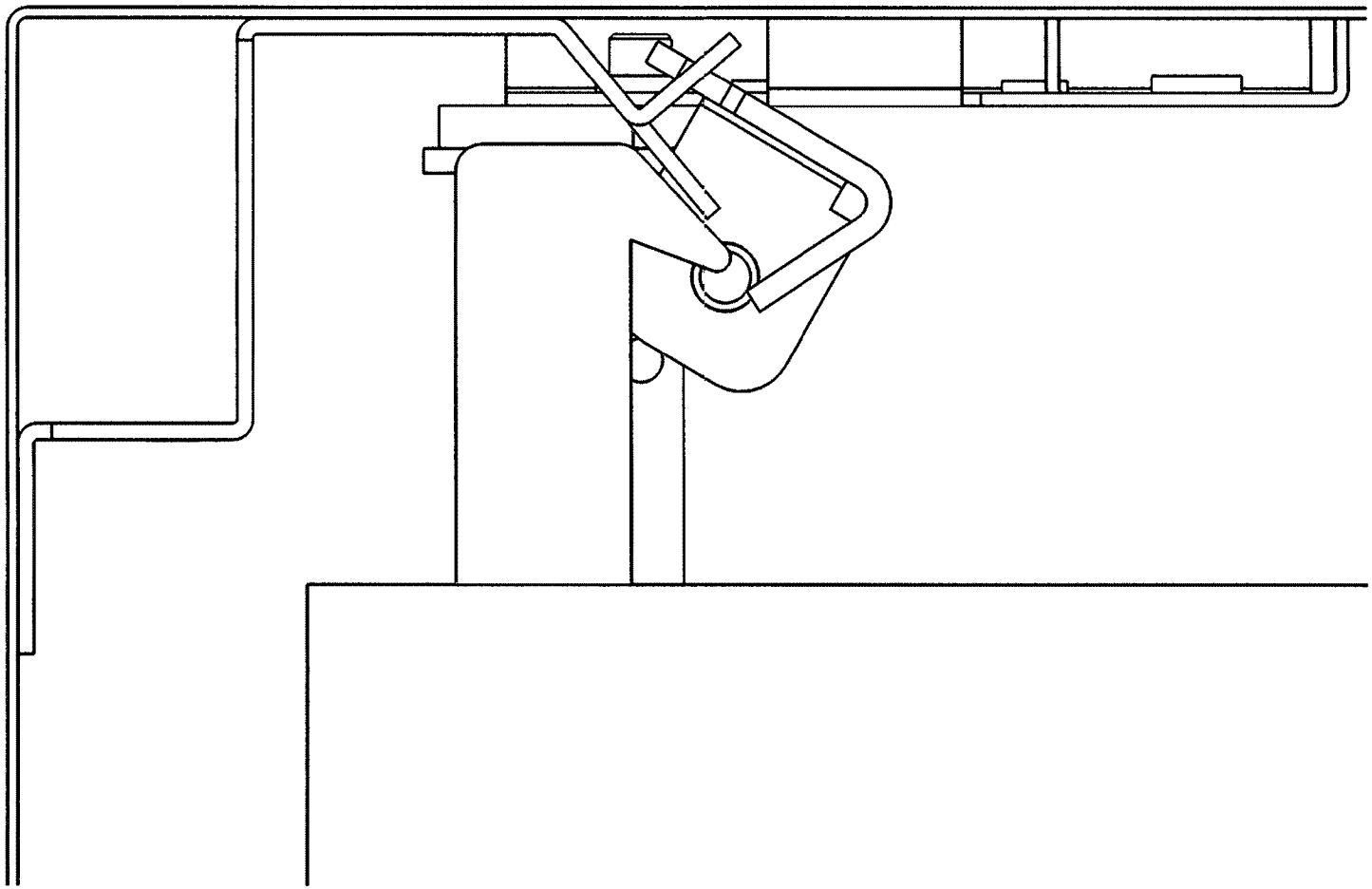
Figure 8 (Prior Art)
FIG. 8 is an enlarged, detail view of the prior art locking assembly of FIG. 7.
Figure 9:
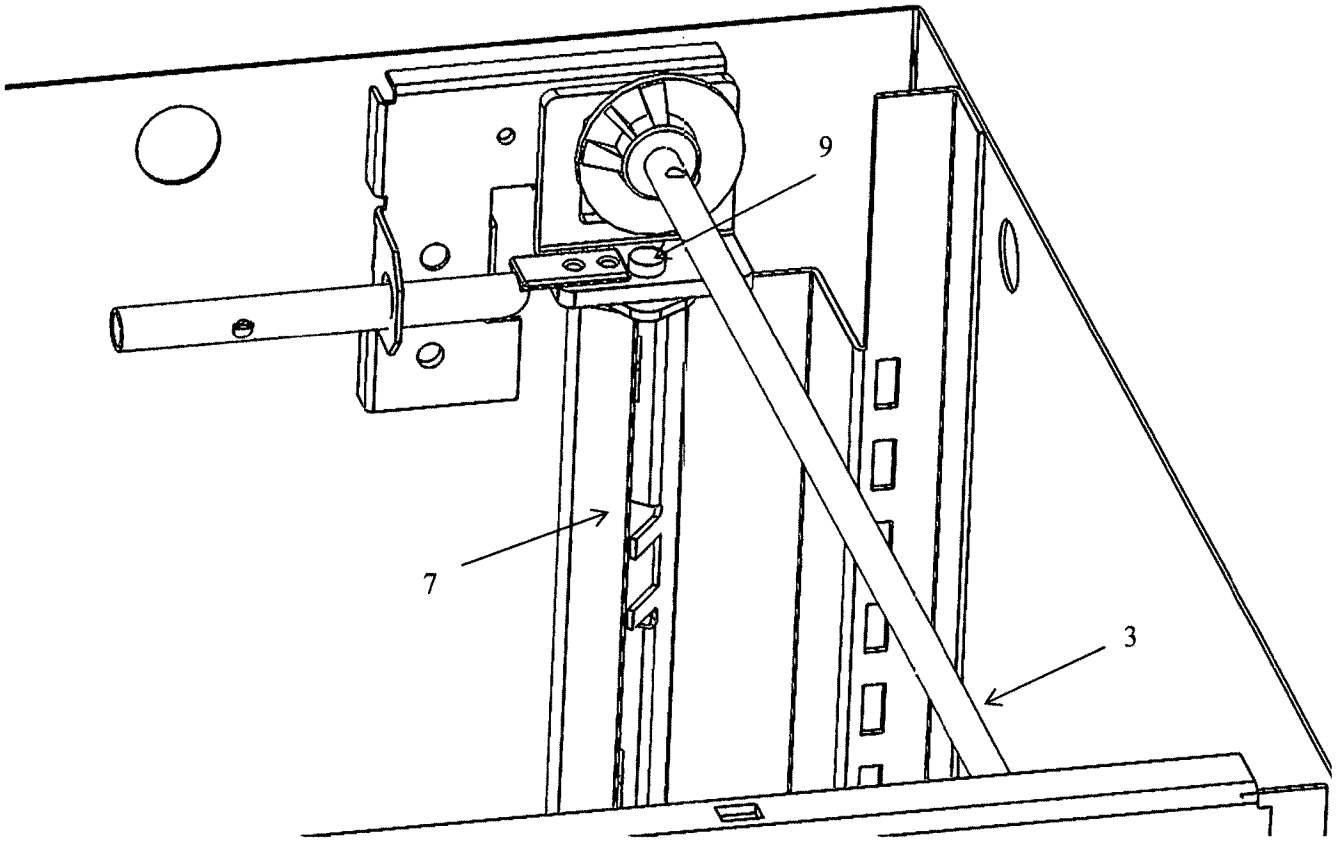
Figure 9 (Prior Art)
FIG. 9 is a perspective view of the prior art locking assembly and lock bar.

Toggle bracket 11*a* comprises a first cam portion (left portion of bracket 11*a* as shown) and a second cam portion (right portion of bracket 11*a* as shown). The first cam portion of toggle bracket 11*a* is generally "L" shaped and comprises a first slot configured in a plane perpendicular to the first axis, and a second slot configured in a plane that is parallel to the first axis and perpendicular to the plane of the first slot. The first slot is illustrated as the generally rectangular opening in toggle bracket 11*a* in which first cam 4 is positioned. The second slot is used to control a lock bar binge via the lock bar hinge pin 9 in the same manner as described above with respect to FIG. 9. The second cam portion of toggle bracket 11*a* is generally flat and comprises a motor cam slot surface configured in a plane perpendicular to the first axis. The motor cam slot surface is illustrated generally as the left edge a vertical inn portion extending upward from the bottom portion of the second cam portion of the toggle bracket 11*a*. This motor cam slot surface contacts motor cam 13 along the left edge of the vertical arm portion as illustrated.

Figure 11:
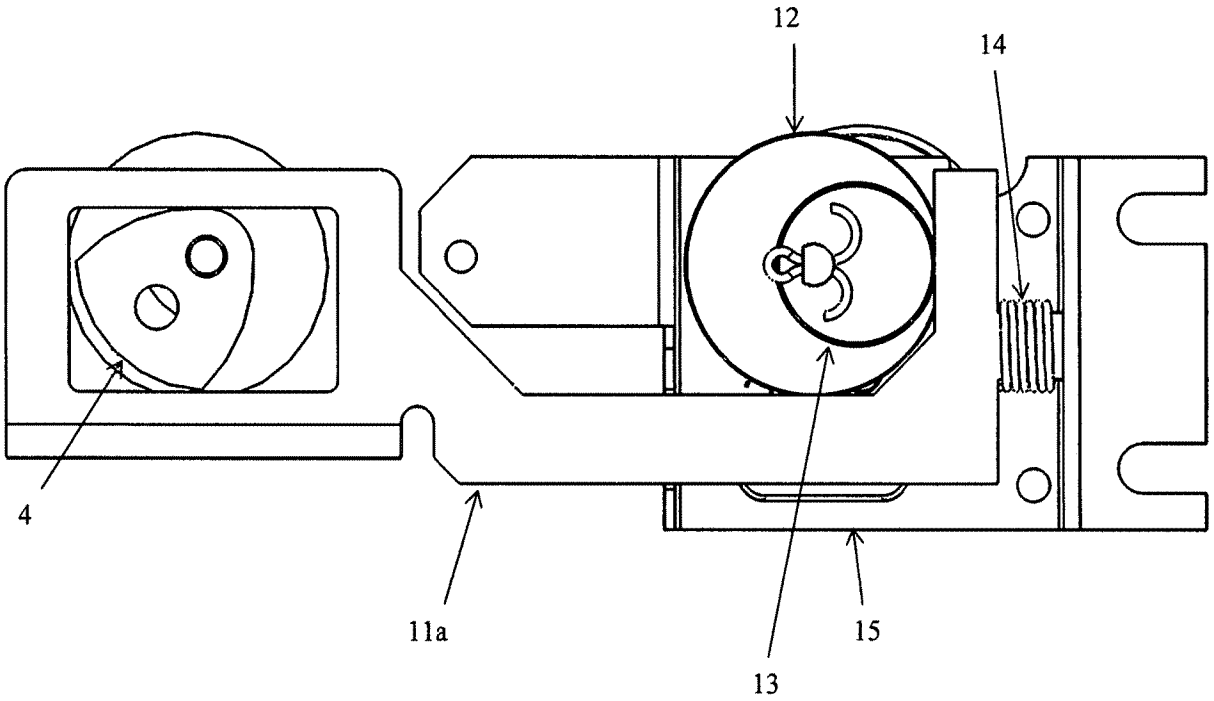
FIG. 11 is a rear view of the integrated mechanical lock and motorized locking mechanism of FIG. 10 in its unlocked position, unlocked by a second cam.
Figure 13:
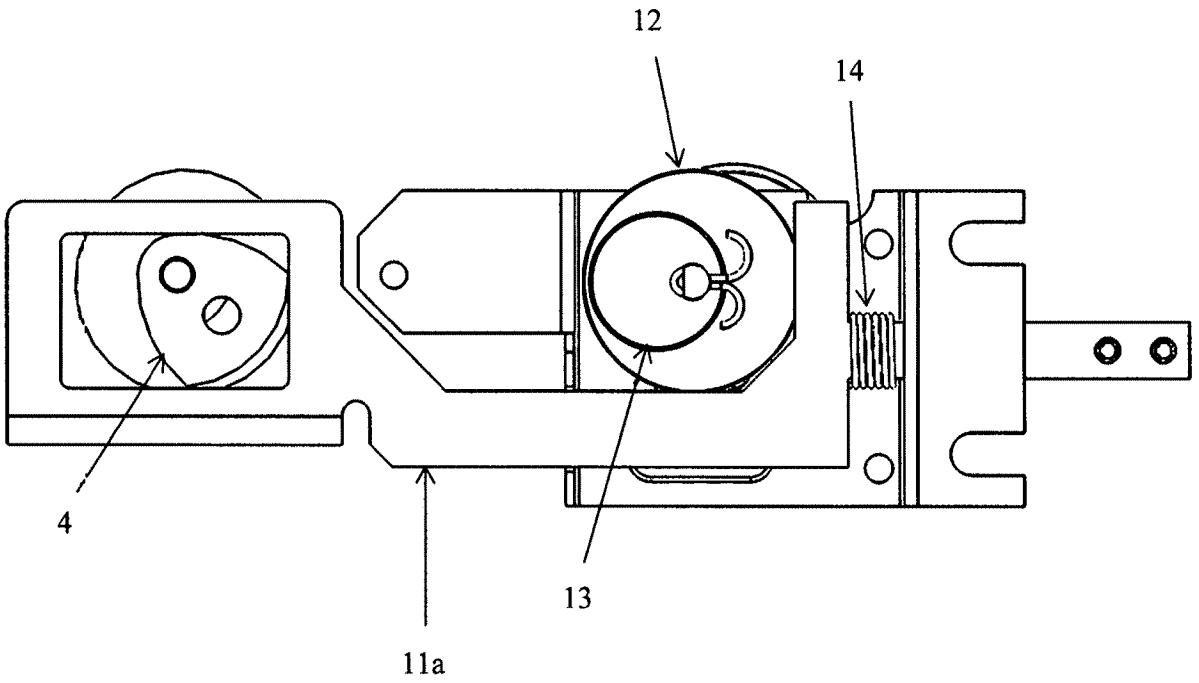
FIG. 13 is a rear view of the integrated mechanical lock and motorized locking mechanism of FIG. 10 in its unlocked position, unlocked by a first cam.

Movement of toggle bracket 11*a* from its locked position to its unlocked position can be controlled mechanically by the first cam 4 moving in and pushing against the right side of the first slot, as illustrated in FIG. 13. Movement of toggle bracket 11*a* from its locked position to its unlocked position can also be controlled electronically by a second cam or motor cam 13 pushing against the motor cam slot surface along the left edge of the vertical arm portion of the second cam portion of the toggle bracket 11*a*, as illustrated in FIGS. 10 and 11. Movement of toggle bracket 11*a* from its unlocked position to its locked position is controlled mechanically by spring 14 pushing against mounting bracket 15 to bias toggle bracket 11*a* to the left or towards the locked position.

As the toggle bracket 11*a* slides from left to right by the force of either the first cam 4 or the second cam 13 to unlock the cabinet, the second slot is shifted from the left to the right and applies a rotation force on the hinge pin 9, thereby rotating the lock bar hinge and thus the lock bar 7 out from a position that interferes with the drawers of the cabinet. Conversely, as the toggle bracket 11*a* slides from right to left by the force of the spring 14 to lock the cabinet, the second slot is shifted from the right to the left and applies a rotation force on the binge pin 9, thereby rotating the lock bar hinge and thus the lock bar 7 into a position that interferes with the drawers of the cabinet.

In FIGS. 10 and 11, motor cam 13 is shown driving toggle bracket 11*a* to the right against the force of spring 14 to unlock the cabinet. Motor 12 is mounted to mounting bracket 15 and drives cam 13, which in turn drives toggle bracket 11*a* by sliding the toggle bracket 11*a* in a direction that is perpendicular to the first axis. The toggle bracket 11*a* slides from left to right by the motor earn 13 applying a force to the slot surface along the left edge of the vertical arm portion of the second cam portion of the toggle bracket 11*a*, i.e., to the surface of toggle bracket 11*a* which is in contact with the motor earn 13 as illustrated in FIGS. 10 and 11. The extra space in the first slot afforded by the rectangular shape of the first slot in the modified toggle bracket 11*a* allows the toggle bracket 11*a* to move to the right, i.e., to its unlocked position without interference from cam 4. Thus, while mechanical lock 2 remains in its locked position, motor cam 13 can still drive the toggle bracket 11*a* to the right to its unlocked position, while cam 4 applies no resistance to toggle bracket 11.

Figure 12:
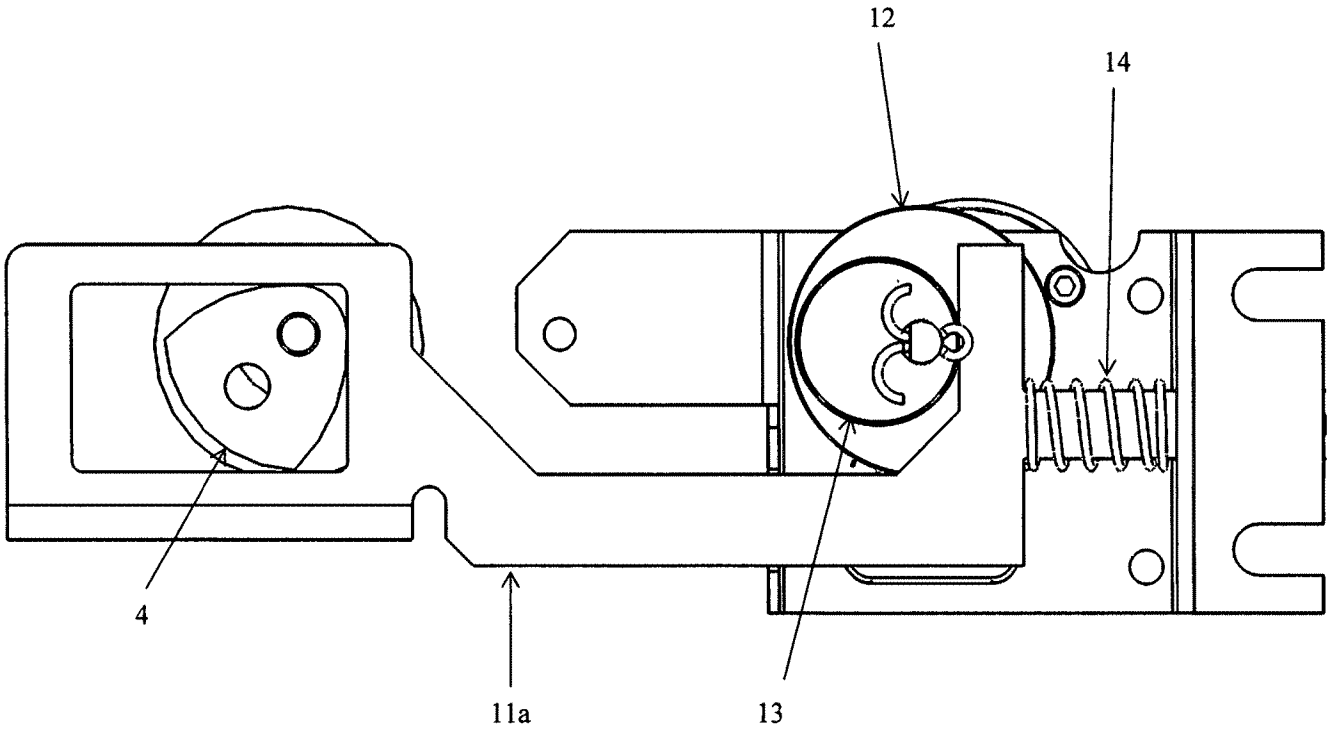
FIG. 12 is a rear view of the integrated mechanical lock and motorized locking mechanism of FIG. 10 in its locked position.

In FIG. 12, motor 12 has rotated motor cam 13 one hundred and eighty degrees from its unlocked position shown in FIGS. 10 and 11 to its locked position of FIG. 12, allowing spring 14 to push or slide the toggle bracket 11*a* to the left or to the locked position to lock the cabinet. Once again, mechanical lock 2 and cam 4 remain in their locked position and do not interfere in any way with the movement of toggle bracket 11*a* by the motor cam 13 and spring 14. In this manner, the toggle bracket 11*a* can be unlocked and locked by the motor 12 while the mechanical lock 2 and cam 4 are in their locked position.

In FIG. 13, cam 4 is rotated ninety degrees from its locked position shown in FIGS. 10-12 to its unlocked position of FIG. 11, and drives bracket 11*a* to the right against the force of spring 14 to its unlocked position. Thus, unlocking is achieved by rotating the mechanical lock only and by no contribution of motor 12 and/or motor cam 13. Motor cam 13 remains in its locked position and does not interfere in any way with the movement of the toggle bracket 11*a* by the cam 4 and spring 14. To re-lock the cabinet by mechanical lock 2, the lock is rotated thus rotating cam 4 back to its locked position, as spring 14 slides bracket 11*a* to the left to lock the cabinet. In this manner, the toggle bracket 11*a* can be unlocked and locked by the mechanical lock 2 and cam 4 while the motor cam 13 is in its locked position.

Figure 14:
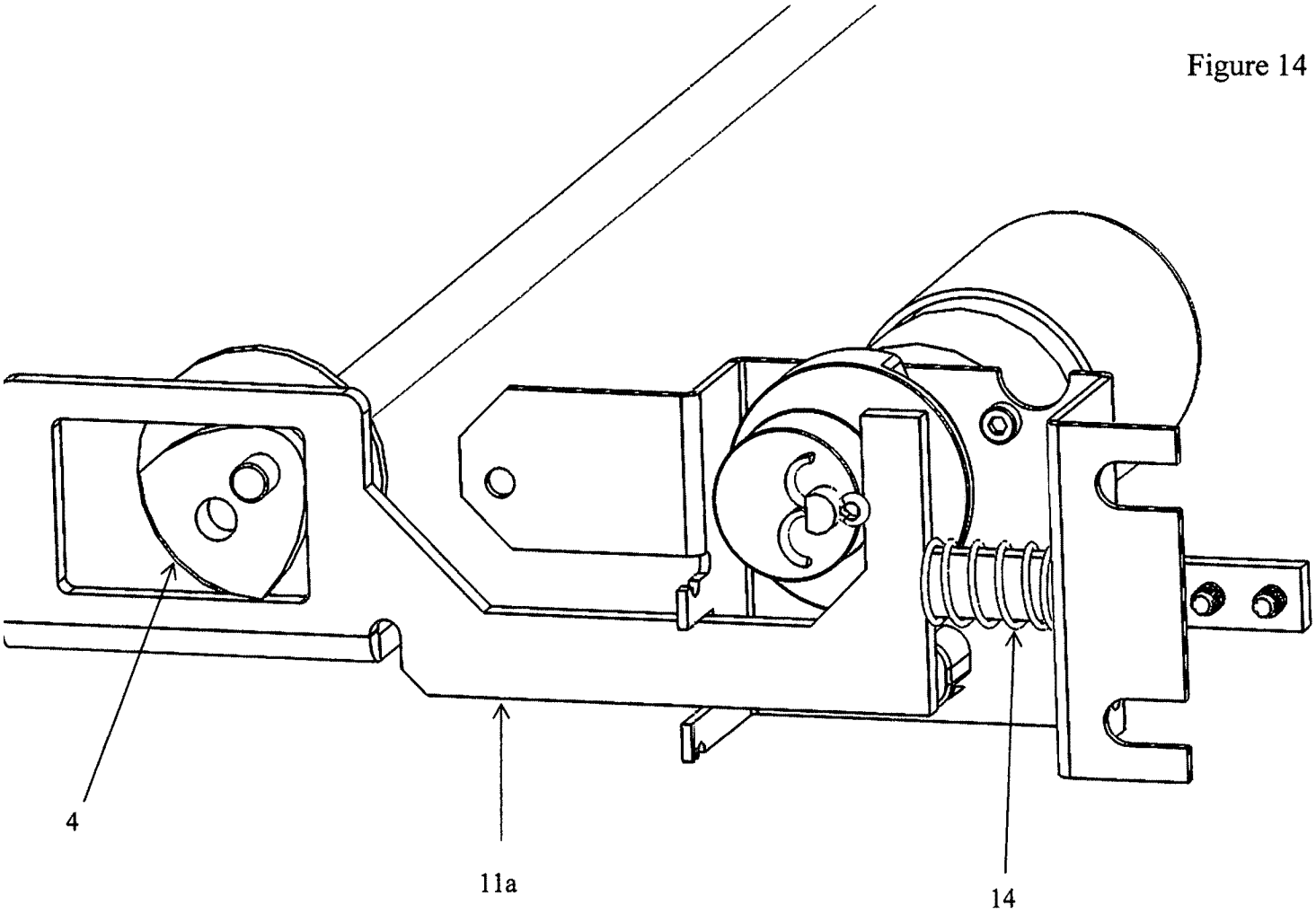
FIG. 14 is a top rear perspective view of the integrated mechanical lock and motorized locking mechanism of FIG. 10 in its locked position.

FIG. 14 is a perspective view of the integrated mechanical lock and motorized locking mechanism in its locked position, wherein both cam 4 and motor cam 13 are in their locked positions, and spring 14 biases the toggle bracket 11*a* to the left to its locked position. It should be understood from the above description that either cam 4 or motor cam 13 can be rotated independently to their unlocked positions respectively, to drive the toggle bracket 11*a* to its unlocked position, without interference.

Rotation of cam 4 is achieved mechanically by the use of a key. Rotation of the motor cam 13 is achieved electronically by motor 12. The motor is controlled in any suitable manner know in the art, such as via a key pad or a transmitter fob. The motor control includes any suitable control circuitry and/or electrical components as may be needed for proper functioning as is known in the art. Further the motor can be powered by any suitable power source, including but not limited to batteries. By way of example only the control of the motorized lock mechanism may include motor controlled lock mechanisms described in U.S. Pat. No. 8,876,172 entitled Vending Machine Lock with Motor Controlled Slide Bar and Hook Mechanism and Electronic Access, issued to Denison et al. on Nov. 4, 2014, the entire disclosure of which is herein incorporated by reference.

While the above discussed embodiment(s) have been described with reference to a cabinet, it should be understood that the integrated mechanical lock and motorized lock mechanism of present disclosure can also be mounted on other suitable enclosures in which a toggle assembly is used to lock and unlock the enclosure. In general, the toggle bracket 11*a* can take any suitable size and shape, and can be driven in any suitable manner by any suitable drive mechanisms. Also, the cams can take any suitable size and shape to impart motion to the toggle assembly. In its broadest sense, the lock toggle assembly can be locked and unlocked via both a key and a keyless lock mechanism, both of which may function independently of each other and without interfering with each other. Additionally, the components of the integrated mechanical lock and motorized lock mechanism can be made from arts suitable material, such as metal, plastic, or any suitable material capable of adequately performing their respective intended functions.

While the preferred and alternate embodiment(s) are illustrative of the structure, function and operation of the exemplary method(s), system(s) and device(s), it should be understood that various modifications may be made thereto with departing from the teachings herein. While the foregoing discussion presents the teachings in an exemplary fashion with respect to the disclosed method, system and device for an integrated mechanical lock and motorized lock mechanism, it will be apparent to those skilled in the art that the teachings may apply to any type of enclosure having a mechanical lock and toggle assembly. Further, while the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein.

What is claimed is:

1. A locking mechanism, comprising:

a toggle assembly selectively positionable in a locked and an unlocked position, the toggle assembly having a first cam portion, a second cam portion, and a slot adapted to operatively engage a hinge pin of a lock bar hinge;

a first drive mechanism for selectively moving the toggle assembly to its unlocked position by contact with the first cam portion; and a second drive mechanism for selectively moving the toggle assembly to its unlocked position by contact with the second cam portion;

wherein the first drive mechanism and the second drive mechanism are adapted to operate the toggle assembly independently of each other.

2. The locking mechanism of claim 1, wherein the first drive mechanism is a mechanical cam operable mechanically.

3. The locking mechanism of claim 2, wherein the mechanical cam is operable via a key.

4. The locking mechanism of claim 1, wherein the second drive mechanism is a motorized cam operable electronically.

5. The locking mechanism of claim 4, wherein the motorized cam is operable via a keyless device.

6. The locking mechanism of claim 1, further comprising a third drive mechanism for moving the toggle assembly to its locked position.

7. The locking mechanism of claim 6, wherein the third drive mechanism is a spring.

8. The locking mechanism of claim 1, wherein the first cam portion defines a rectangular slot.

9. An integrated mechanical lock and motorized lock mechanism for a cabinet having a lock bar and a toggle assembly for positioning the lock bar in one of a locked position and an unlocked position, comprising:

a toggle bracket selectively positionable in a locked and an unlocked position, the toggle bracket having a first cam portion, a second cam portion, and a slot adapted to operatively engage a hinge pin of a lock bar hinge;

a first cam for selectively moving the toggle bracket to its unlocked position by contact with the first cam portion; and a second cam for selectively moving the toggle bracket to its unlocked position by contact with the second cam portion;

wherein the first cam and the second cam are adapted to operate the toggle bracket independently of each other.

10. The integrated mechanical lock and motorized lock mechanism of claim 9, wherein the first cam is a mechanical cam operable via a key.

11. The integrated mechanical lock and motorized lock mechanism of claim 9, wherein the second cam is a motorized cam operable via a keyless device.

12. The integrated mechanical lock and motorized lock mechanism of claim 9, wherein the first cam is selectively engagable with the first cam portion of the toggle bracket to move both the first cam portion and the second cam portion of the toggle bracket.

13. The integrated mechanical lock and motorized lock mechanism of claim 9, wherein the second cam is selectively engagable with the second cam portion of the toggle bracket to move both the first cam portion and the second cam portion of the toggle bracket.

14. The integrated mechanical lock and motorized lock mechanism of claim 9, further comprising a spring for biasing the toggle bracket to its locked position.

15. The integrated mechanical lock and motorized lock mechanism of claim 9, wherein the first cam portion defines a rectangular slot.

16. A method for locking a cabinet having a mechanical lock, mechanical cam, toggle assembly and lock bar, the method comprising the steps of:

providing a toggle bracket in the toggle assembly, wherein the toggle bracket is selectively positionable in a locked and an unlocked position for moving the lock bar to a locked and an unlocked position, wherein the toggle bracket includes a first cam surface, a second cam surface, and a slot adapted to operatively engage a hinge pin of a lock bar hinge;

operatively associating the mechanical cam with the first cam surface of the toggle bracket; and operatively associating a motorized cam with the second cam surface of the toggle bracket;

wherein the first cam and the second cam are selectively drivable independently of each other to move the toggle assembly from its locked position to its unlocked position.

17. The method of claim 16, further comprising the step of driving the mechanical cam via a key.

18. The method of claim 16, comprising the step of driving the motorized cam via a keyless device.

19. The method of claim 16, further comprising the step of biasing the toggle bracket to its locked position via a spring.

20. The method of claim 16, wherein the first cam surface defines a rectangular slot.

21. An integrated mechanical lock and motorized lock mechanism for a cabinet having a lock bar and a toggle assembly for positioning the lock bar in one of a locked position and an unlocked position, comprising:

a toggle bracket moveable horizontally relative to a top surface of the cabinet, and selectively positionable in a lock position and an unlock position, the toggle bracket having a first cam portion and a second cam portion;

a mechanical cam adapted to engage the first cam portion of the toggle bracket for selectively moving the toggle bracket horizontally to its unlock position; and a motorized cam adapted to engage the second cam portion of the toggle bracket for selectively moving the toggle bracket horizontally to its unlock position;

wherein the toggle bracket is adapted to move horizontally via one of the mechanical cam and the motorized cam without interference from the other of the mechanical cam and the motorized cam.

22. The integrated mechanical lock and motorized lock mechanism of claim 21, wherein the motorized lock mechanism is adapted to reside proximate the top surface of the cabinet.

23. The integrated mechanical lock and motorized lock mechanism of claim 22, wherein the motorized lock mechanism is adapted to reside proximate a rear portion of the cabinet.

* * * * *